US005134739A

United States Patent [19]

Gaffe et al.

[11] Patent Number: 5,134,739

[45] Date of Patent: Aug. 4, 1992

[54] THERAPEUTIC AND PREVENTIVE DEVICE FOR GIVING A SET POSITION TO LOWER LIMBS

[76] Inventors: Michel Gaffe, 12, rue Jean-Baptiste Baussard, Le Buquet - 14600 Honfleur; Pierre Planquois, 30, rue des Loisirs, 76700 Harfleur, both of France

[21] Appl. No.: 684,968

[22] PCT Filed: Sep. 25, 1990

[86] PCT No.: PCT/FR90/00687

§ 371 Date: Jul. 2, 1991

§ 102(e) Date: Jul. 2, 1991

[87] PCT Pub. No.: WO91/04000

PCT Pub. Date: Apr. 4, 1991

[30] Foreign Application Priority Data

Sep. 25, 1989 [FR] France ..... 89 12519

[51] Int. Cl.[5] ..... A47C 20/02

[52] U.S. Cl. ..... 5/648; 5/624; 602/23

[58] Field of Search ..... 5/431, 443, 444; 128/80 R, 80 A, 87 C

[56] References Cited

U.S. PATENT DOCUMENTS

| | | | |
|---|---|---|---|
| 4,185,813 | 1/1980 | Spann | 5/443 X |
| 4,327,714 | 5/1982 | Spann | 5/443 X |
| 4,392,489 | 7/1983 | Wagner, Sr. | 5/443 X |
| 4,471,952 | 9/1984 | Spann | 5/443 X |
| 4,805,605 | 2/1989 | Glassman | 5/443 X |
| 4,889,109 | 12/1989 | Gifford | 128/80 A |
| 4,910,818 | 3/1990 | Grabill et al. | 5/443 |

*Primary Examiner*—Michael F. Trettel
*Attorney, Agent, or Firm*—Fisher, Christen & Sabol

[57] ABSTRACT

A device for giving a set position to the lower limbs of persons required to remain in a supine position for an extended period, comprises a central block (1) which is provided with two side support surfaces (2*a* and 2*b*) for the legs of the person. The two surfaces are arranged according to two vertical planes which converge on the subject and define the angle at which his lower limbs are to be set. At least one of said side support surfaces of the central block is associated with at least one side support (5, 5') to allow the corresponding leg to rest. This support may be placed against the surface of the central block and comprises an upward-facing surface (6) with a concave profile which ensures a comfortable and stable position of the leg.

4 Claims, 3 Drawing Sheets

THERAPEUTIC AND PREVENTIVE DEVICE FOR GIVING A SET POSITION TO LOWER LIMBS

The present invention relates to a device intended to allow lower limbs to be positioned, as desired, for persons having to remain in a supine position for a more or less extended period.

The present invention responds to several objects:

In the first place, it will enable persons having to remain lying down, whether it be question of persons immobilized momentarily further to functional disorders or even of bed-ridden persons.

It is known that such persons who remain lying on their back for long periods of time are subject to bed-sores, particularly on those parts of the body which remain in permanent contact with the rest surface; material means have been developed in order to overcome the formation of bed-sores, particularly in the form of air beds comprising internal cells which are alternately placed under pressure, so as to alternate the parts of the body which are in position of support; however, this method is inefficient in the case of the formation of bed-sores on the heels, being given the very punctual and permanent character of the rest position occupied by this part of the body, the patient lying on his back.

It is therefore a first object of the invention to allow the patient to remain in supine position for an extended period of time, whilst avoiding the formation of bed-sores on the heels, on the one hand, or to reduce the duration of cure of the existing bed-sore.

Another object of the invention aims at making it possible to ensure a precise positioning of the lower limbs under specific circumstances requiring, at least during an intermediate period of time, that the lower limbs of a patient in supine position be maintained stable at a determined angle.

Such is the case in particular of patients having undergone an operation resulting in a prosthesis being positioned at hip level; whenever patients have undergone a hip operation by total or partial arthroplasty, it is desirable, in order to avoid a post-operatory dislocation, to ensure positioning and maintenance of the lower limbs at a precise angle.

The invention responds to this end and furthermore makes it possible to avoid muscular tensions of the retentor muscles in the buttocks, and finally to maintain in suitable position osteotomies and bone grafts of the hip or pelvis; for example MacMurray or Chiari osteotomy.

A third object of the invention will be to ensure, by a centripetal inclined position of the lower limbs, an improved venous circulation, avoiding, furthermore, risks of oedema of the lower limbs.

Finally, and according to a more general object of the invention, the latter will be applicable to all circumstances in which it is desirable to ensure a comfortable rest of the lower limbs of a bed-ridden patient and more especially whenever the patient will have suffered traumatisms at that level, for example in the case of patients having multiple injuries of the lower limbs, patients having undergone a punctual surgical operation on the thigh, knee, leg and ankle, including continuous tractions, etc. . .

To that end, the invention relates to a device for giving a set position to the lower limbs of persons required to remain in a supine position for an extended period, said device being characterized in that it comprises at least one block offering two side support surfaces for the legs, the vertical planes of the two surfaces converging at a determined angle corresponding to the desired positioning of the two lower limbs.

More especially, the block is preferably constituted by a hexahedral structure, comprising two horizontal parallel surfaces of trapezoidal shape, respectively upper and lower, connected together by the two side support surfaces converging towards the patient.

It will be understood that these two surfaces for supporting the limbs thus define the appropriate angle, the patient being required to maintain his two legs against its two faces diverging towards the feet, thus constituting a correct angular point of reference for positioning the legs.

The block is preferably made of elastically compressible, semi-rigid material so as to allow a comfortable contact.

According to another embodiment of the invention, the device provided to give a set position to the lower limbs for patients required to remain in a supine position for an extended period, is constituted by at least one support receiving the rear face of the patient's leg in that part of the leg extending from the bend of the knee to the ankle and this support is constituted by a longiform cushion offering an upward-facing surface for receiving the leg of generally concave shape.

More especially, this support comprises, at least on a part of its concave surface, a profile substantially close to a segment of cylinder.

According to a more particular development of this embodiment, the concave surface receiving the rear part of the leg slopes from the distal end corresponding to the rest of the rear part of the ankle towards the proximal part corresponding to the rest of the bend of the knee.

According to a more particular embodiment, the support of the leg is in addition associated with an inclined plane extending the proximal end supporting the bend of the knee and this inclined plane is thus adapted to receive the rear face of the thigh, this inclined plane terminating in the proximity of the plane of rest of the buttocks.

According to a more complete development of the invention, the device comprises a central block provided with the two side support surfaces for the legs, the two surfaces being disposed in vertical planes converging towards the patient, defining the angle at which his lower limbs are to be set and at least one of said side support surfaces of the central block is associated with a side support for the corresponding leg to rest, this support possibly being provided to be removable and capable of being positioned against the surface of the central block, the side support comprising an upward-facing surface of concave profile which ensures a comfortable and stable position of the leg.

According to a development of the invention, the central block is associated, on each side and along each side surface diverging towards the feet and converging towards the patient, with a support for each leg to rest, this support comprising an upward-facing concave surface for the leg to rest.

More especially within the framework of this development, each of the side supports associated with the central block comprises an upward-facing rest surface provided with a substantially plane part, joining the divergent side surface of the central block, this plane face being extended and outwardly bordered by a concavity in the form of a quarter of a cylinder.

Each of said supports preferably comprises in this case a slope oriented towards the patient, allowing the feet to be in raised position with respect to the pelvis.

According to a more particular characteristic, each of the elements is made of synthetic material of elastically compressible cellular structure, coated with a continuous surfacing of synthetic material.

Other characteristics and advantages of the invention will appear from the following description given in connection with embodiments shown by way of non-limiting example.

Figure 1:
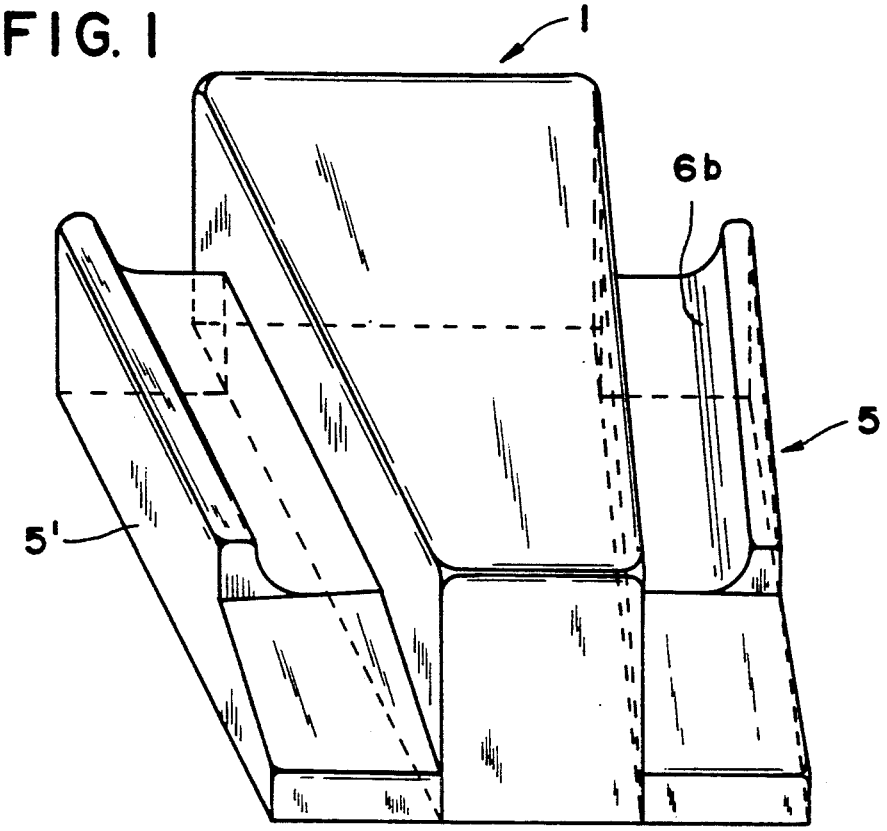
FIG. 1 shows a view of the complete device comprising a central block and two side supports.

According to all the Figures, it is seen that the device essentially comprises a central block 1 of general hexahedral shape and comprising two side surfaces 2a, 2b diverging towards the outside and converging towards the patient.

The angle of the two faces 2a and 2b is defined as a function of needs and it is thus possible according to the invention to make a set of central blocks of different angles as a function, on the one hand, of the morphological characteristics of the user patients and, on the other hand, as a function of the particular cases and the doctor's recommendations.

The central block is preferably made of synthetic material such as a slightly supple, elastically compressible foam to allow non-aggressive contact; this block, like the supports described hereinbelow, will preferably be covered with a likewise supple material forming for example a synthetic matter.

According to FIGS. 1 to 4, the hexahedral block comprises two horizontal surfaces, viz. an upper surface 3a and a lower surface 3b, resting on the plane bearing the patient.

These two horizontal surfaces are joined by the side support surfaces 2a and 2b described hereinbefore.

At its outer or distal end, the block comprises a rectangular surface and it terminates towards the patient in a likewise quadrangular frontal surface 4.

Figure 2:
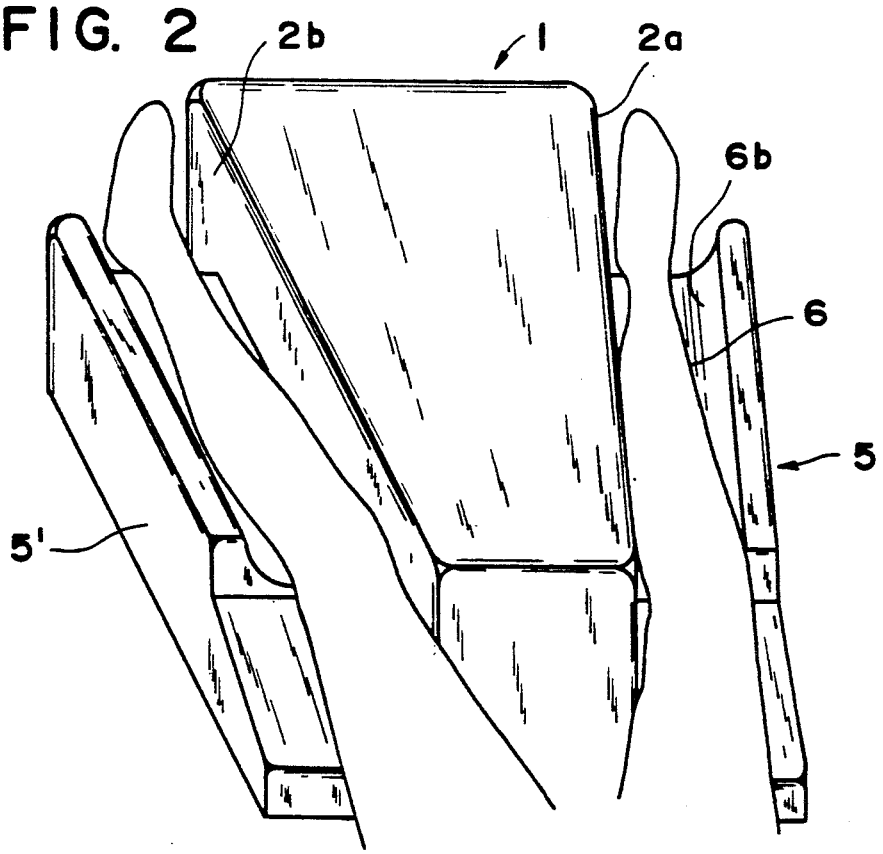
FIG. 2 shows the device of FIG. 1 on which the patient's legs have been shown in position.
Figure 4:
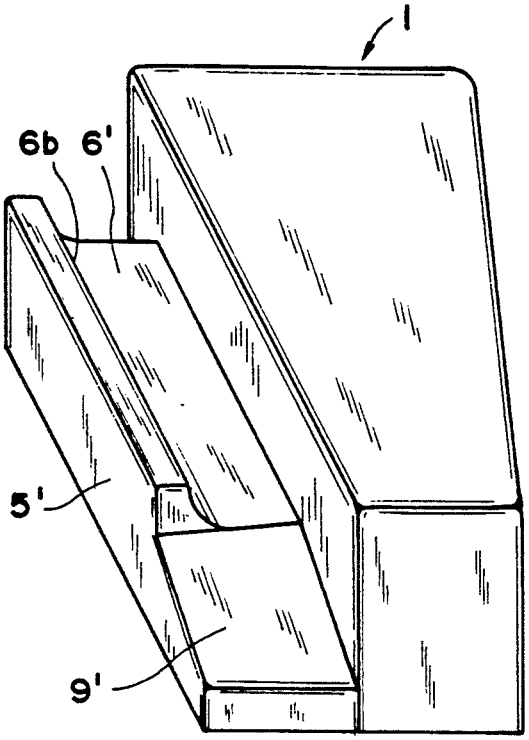
FIG. 4 shows the central block associated with a side support for the left leg.
Figure 3:
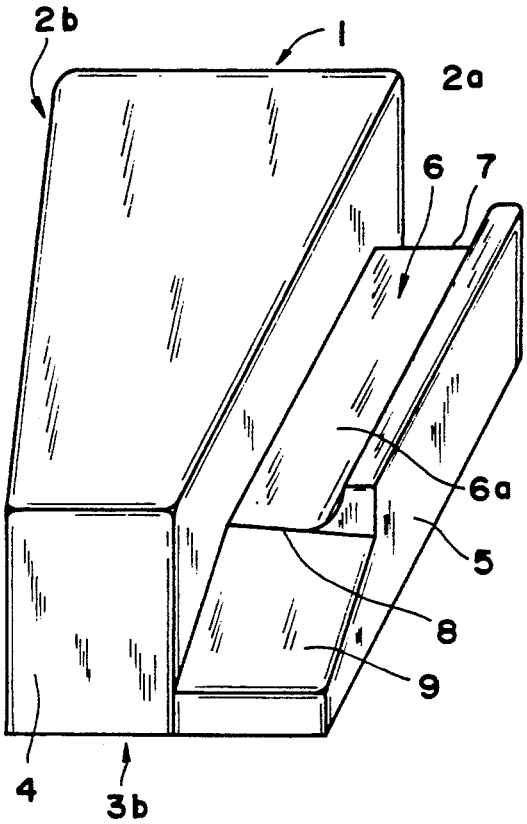
FIG. 3 shows the central block associated with a side support for the right leg.

As is seen in FIGS. 1 and 2, the block is adapted to receive side supports applied against the cheeks constituted by the side surfaces 2a and 2b.

These supports are constituted by longiform elements likewise made of supple and compressible material such as a synthetic foam with a continuous surfacing; each block 5, 5' is therefore provided with a surface 6, 6' for receiving the leg, this surface being of generally concave shape and, according to FIGS. 1 to 4, this surface may advantageously be provided with a substantially plane, horizontal part 6a extended and bordered outwardly by a concavity 6b in the form of a quarter of a cylinder.

In this way, each side support 5, 5' constitutes a cradle for receiving the patient's leg from the zone constituted by the rear face of the bend of the knee and the rear face of the ankle this side of the heel.

Consequently and as shown in FIG. 1, the heel is located outside and the rest plane is constituted by the generally concave surface 6 thus ensuring stable, comfortable rest for the patient.

Furthermore, the angle formed by the legs is defined by the angle of the vertical planes corresponding to the cheeks or side surfaces 2a and 2b; the patient's legs held in the cradles of the supports thus being maintained in stable position and thus avoiding any inappropriate positioning likely to be a source of dislocation in patients resting after an operation.

Furthermore, it is seen in FIGS. 1 to 4 that the side supports 5, 5' are provided to be slightly shorter than the central block so that the correct positioning of the foot is thus ensured, the foot being able to rest freely outside the support 5, 5', but being prevented from making a rotation towards the inside by the side surfaces 2a and 2b of the block.

Each support surface 6 of the side support in addition slopes from the distal end 7 corresponding to the rear support of the ankle up to the proximal end 8 corresponding to the support of the bend of the knee.

Consequently, the patient's legs are maintained in inclined position, desirable to promote venous circulation.

Towards the centre, the support extends by an inclined plane 9, 9' starting from the zone 8 of rest for the bend of the knee and substantially joining a level close to the plane of rest of the whole of the device, corresponding to the plane of support of the patient (for example the bed); the proximal end of the inclined plane 9 terminates at the level of the frontal surface 4.

This inclined plane constitutes a zone of rest for the rear faces of the patient's thigh, thus ensuring comfortable positioning of all the lower limbs.

Figure 5:
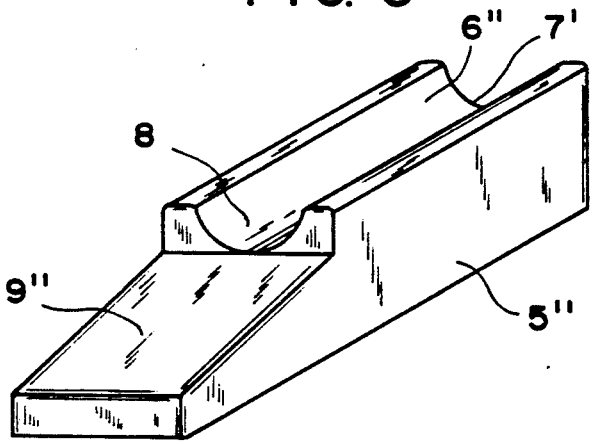
FIG. 5 shows an isolated support for a lower limb.
Figure 6:
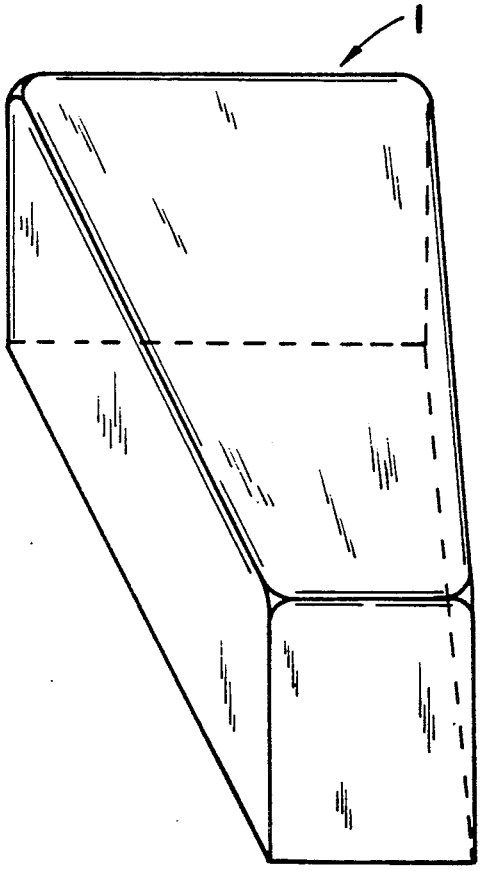
FIG. 6 shows the central block alone.

FIG. 5 shows a variant concerning an isolated support presenting substantially the same characteristics as hereinbefore; this support, constituted by an element 5'', comprises a longiform concavity 6' generally in the form of a segment of cylinder and constituting a cradle for the patient's leg to rest, said leg thus being maintained in a correct position; the support thus made further comprises, as described hereinabove, a slope from its distal end 7' to its proximal end 8' and it is extended on the part oriented towards the patient by an inclined plane 9' for the rear face of the thigh to rest.

Experiments and trials run by Applicants have shown the interest and advantages of the device thus described.

As indicated, it makes it possible to reduce and even eliminate and in any case prevent to a large extent bedsores on the heels in bed-ridden patients.

In the case of patients operated on the hip with total or partial arthroplasty, the device of the invention ensuring correct and stable positioning of the lower limbs avoids risks of dislocation.

The elevation of the terminal ends of the limbs makes it possible to improve the patient's health by an improved circulation.

The device generally ensures comfortable rest, permanent or momentary, of the patients required to remain in bed for an extended period, particularly in the case of persons having undergone a surgical arteriovenous operation, in elderly or frequently bed-ridden persons or in subjects who must remain in a supine position further to disorders at the level of the vertebrae and discs.

We claim:

1. A device for giving a set position to the lower limbs of a patient required to remain in supine position for an extended period, a central block (1) adapted to be positioned on a plane of rest of the patient, being positioned between the legs of the patient, and thus, offering two side support surfaces (2a and 2b) for legs of the patient, the two side support surfaces (2a and 2b) of the central block being disposed along vertical planes converging towards the patient, defining an angle of positioning of the lower limbs of the patient, two independent side leg supports 5, 5', each of the two independent side leg supports being provided for one of the legs of the patient, to rest on, each of the two independent side supports being adapted to be positioned against a surface of the central block which corresponds to said each of the two independent side supports, each of the independent side leg supports comprising an upward-facing surface (6) of concave profile for the comfortable and stable rest of the patient's leg positioned therein, each of the two side leg supports being constituted by a longiform cushion offering an upward-facing surface (6) for receiving the back of one of the legs of the patient and having a transverse shape which is generally concave, and each of the two independent side leg supports comprising at least on a part of its concave surface a profile substantially close to a segment of a cylinder, each of the two independent side leg supports (5, 5') associated with the central block (1) comprising an upward-facing rest surface (6) provided with a substantially plane part (6a) joining one of the two side support surface (2a, 2b) of the central block, the substantially plane part (6a) being extended and outwardly bordered by a side wall (6b) in the form of a quarter of a cylinder, the portion of each of the upward-facing surfaces (6), receiving the back part of the leg of the patient and provided on each of the independent side leg supports, slopes from the end thereof, corresponding to rest for the rear part of the ankle of the patient, towards the part thereof corresponding to rest for the bend of the knee of the patient, and each of the independent leg side supports (5, 5') for the leg in addition being associated with an inclined plane (9, 9') extending the end of each of the two independent side supports which supports the bend of the knee of the patient, the inclined plane, thus, being adapted to receive the rear face of the patient's thigh for the rest thereof, and the inclined plane terminating in the proximity of the plane of rest of the buttocks of the patient.

2. The device according to claim 1 wherein the two independent side leg supports are shorter than the central block, thereby preventing the feet of the patient from turning towards the side cushion of the central block while remaining free at the level of the heel.

3. The device according to claim 1 wherein each of the two independent side leg supports slopes from the position of the heel of the patient to the position of the thigh of the patient.

4. Device according to claim 1 wherein the central block is constituted by a hexahedral structure comprising two parallel, horizontal surfaces (3a, 3b) of trapezoidal form, respectively upper and lower, connected together by the two side support surfaces (2a, 2b) converging towards the patient, the central block and the side cushions or supports being made of a semirigid, elastically compressible material so as to allow comfortable contact, the synthetic material of elastically compressible cellular structure being covered with a continuous surfacing of synthetic material.

* * * * *